US006191804B1

(12) United States Patent
Kitagawa et al.

(10) Patent No.: US 6,191,804 B1
(45) **Date of Patent: *Feb. 20, 2001**

(54) IMAGE FORMING APPARATUS

(75) Inventors: Shunji Kitagawa; Fumio Kaneko; Takao Sugano; Hiroyuki Matsuo; Masayuki Iwasa; Mitsuaki Takeguchi; Masahide Ishigami; Tamotsu Nishiura, all of Kawasaki (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/998,994

(22) Filed: Dec. 29, 1997

(30) Foreign Application Priority Data

Aug. 12, 1997 (JP) ..... 9-217682

(51) Int. Cl.[7] ..... B41J 2/45
(52) U.S. Cl. ..... 347/238; 347/237; 347/130
(58) Field of Search ..... 347/238, 237, 347/241, 247, 130, 225; 257/88, 99

(56) References Cited

U.S. PATENT DOCUMENTS 5,515,136 * 5/1996 Nishio et al. ..... 347/238
5,815,025 * 9/1998 Kubota ..... 347/132
6,008,833 * 9/1998 Ohtsubo et al. ..... 347/237

FOREIGN PATENT DOCUMENTS 57-106230 7/1982 (JP) .
4-323052 11/1992 (JP) .

* cited by examiner

*Primary Examiner*—N. Le
*Assistant Examiner*—Lamson D. Nguyen
(74) *Attorney, Agent, or Firm*—Armstrong, Westerman, Hattori, McLeland & Naughton

(57) ABSTRACT

An image forming apparatus includes: a plurality of light-emitting elements, each light-emitting element receiving a driving current from a power supply and converting the current into a beam; a plurality of driving elements, each driving element being interposed between the power supply and each light-emitting element and controlling the driving current based on an image signal; and a photoconductor on which the beams from the plurality of light-emitting elements form an image by scanning, wherein each light-emitting element is positioned so immediately adjacent to each driving element that a power leakage factor floating therebetween is reduced, whereby an intensity of the beam is substantially equivalent to the image signal in waveform.

9 Claims, 7 Drawing Sheets

IMAGE FORMING APPARATUS

BACKGROUND OF THE INVENTION

1.Field of the Invention

The present invention relates to an image forming apparatus, and in particular, to a multi-beam image forming apparatus such as a copier or a printer that forms an image with a plurality of laser beams for improvement in image forming speed.

2.Description of the Related Art

Due to a need for printing a high-quality image with high resolution and at high speed, a multi-beam image forming apparatus, which is made to scan in parallel the surface of a drum photoconductor by a plurality of laser beams, is being tested for realization in a latest image forming apparatus of electrophotographic type. Such a multi-beam image forming apparatus has a significant technical problem in practical use. That is, the problem is how the light-and-shade difference among image lines formed by the laser beams can be harmoniously adjusted.

More specifically, in the multi-beam image forming apparatus, a distortion occurs in an electric current due to a stray capacitance existing in a driving element supplying a driving electric current to a laser diode, in its electric current passageway and the like, rendering it difficult to adjust an image density. Moreover, since a fluctuation occurs in the image density for each dot and a moire occurs in the formed image, it is difficult to solve the problem of image quality by merely adjusting the driving electric current for each laser diode.

SUMMARY OF THE INVENTION

The present invention has been made under such circumstances and aims to provide an image forming apparatus, which can decrease the undesirable effect due to a stray capacitance existing in the environments of each driving element, electric current passageways, and the like, and in which the density of image formed by each beam can be easily adjusted by reforming the electric current waveform, and substantially no moiré is produced.

Accordingly, the present invention provides an image forming apparatus comprising: a plurality of light-emitting elements, each light-emitting element receiving a driving current from a power supply and converting the current into a beam; a plurality of driving elements, each driving element being interposed between the power supply and each light-emitting element and controlling the driving current based on an image signal; and a photoconductor on which the beams from the plurality of light-emitting elements form an image by scanning, wherein each light-emitting element is positioned so adjacent to each driving element that a power leakage factor floating between the light-emitting element and the driving element is reduced, whereby an intensity of the beam is substantially equivalent to the image signal in waveform.

The feature that the light-emitting element is positioned adjacent to the driving element means that the distance between the both elements is designed to be smaller than several centimeters to minimize a wiring from the light-emitting element to the driving element. This can be realized by mounting the light-emitting element and the driving element on a single printed circuit board, for example. Here, the power leakage factor includes at least one of a stray capacitance, a stray conductance, and a stray inductance.

BRIEF DESCRIPTION OF THE DRAWINGS

FIG. 8(*b*) is a view showing a light intensity waveform of the laser diode in response to the video signal according to a comparative example;

FIG. 8(*c*) is a view showing a light intensity waveform of the laser diode in response to the video signal according to a comparative example;

FIG. 8(*d*) is a view showing a light intensity waveform of the laser diode in response to the video signal according to a comparative example; and FIG. 8(*e*) is a view showing a light intensity waveform of the laser diode in response to the video signal according to the present invention.

DETAILED DESCRIPTION OF THE PREFERRED EMBODIMENTS

Figure 1:
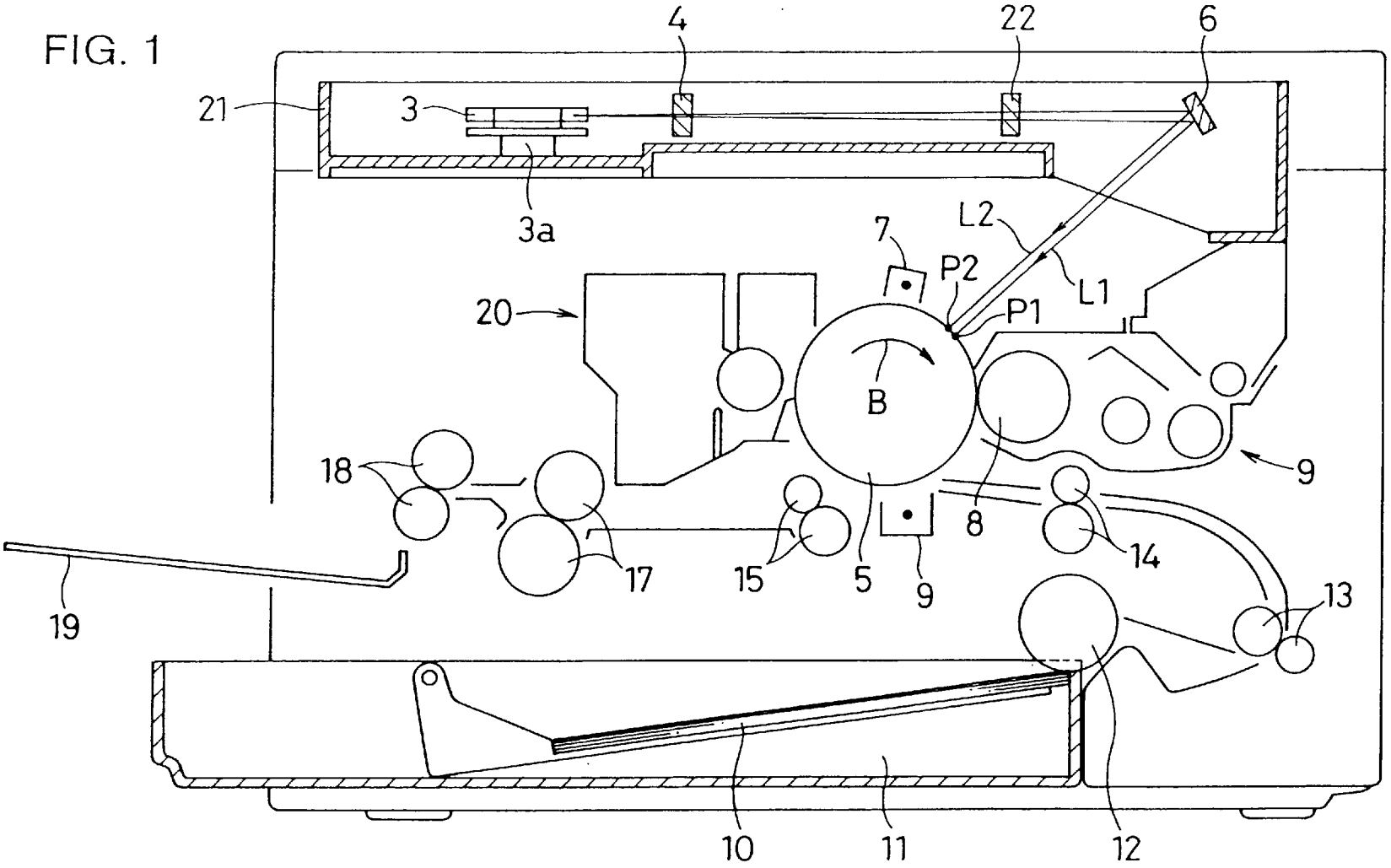
FIG. 1 is an explanatory view showing a basic construction of a laser printer according to an embodiment of the present invention.

Preferably, the light-emitting element of the present invention may include a laser diode.

The laser diode is, in general, mounted in a metallic package, either or its cathode and anode being connected to the package. Particularly in the present invention, it is desirable to use a laser diode in which the anode is electrically connected to the metallic package.

With reference to such a laser diode, the anode is connected to a positive electrode of the power supply, and the cathode is connected to a negative electrode of the power supply through the driving element, thus allowing the metallic package (anode) to be connected to the power supply. Accordingly, because any stray capacitance existing between the metallic package and the ground is always charged always by the power supply, the driving current is not affected by an electric current for charging the stray capacitance.

In this case, the driving element is connected to the cathode of the laser diode, and the driving current is switched by a video signal to perform on-off control of the beams. Thus, the video signal is directly reflected upon the laser diode driving current unless there is an extra electric current flowing passageway other than the driving element.

Also, in the case where the laser diode further includes a photodiode within the metallic package for monitoring a laser beam emitted by the laser diode, a cathode of the photodiode is preferably connected electrically to the metallic package corresponding to the anode of the laser diode so as to be kept in a reverse bias state. This allows a stray capacitance existing between the photodiode and the ground to be always charged by the power supply, so that this charging current no longer affects the laser diode driving current.

Furthermore, it is desirable that each laser diode and each driving element are mounted on a single printed circuit board. This allows a conductor wire connecting the laser diode and the driving element to be minimized, reducing the stray capacitance existing between the conductor wire and the ground and stabilizing a waveform of the driving current. In this case, it is further desirable that the driving element integrally includes a switching circuit equipped with a means for adjusting the driving current, and is arranged as close to the corresponding laser diode as possible.

It is also desirable that a snubber circuit is electrically connected parallel to the laser diode. This allows the waveform of the laser diode driving current to be reformed.

The present invention is now described with reference to an embodiment shown in the drawings.

1. Overall Construction and Operation of a Printer

An overall construction of a laser printer of multi-beam type according to the present invention is now described with reference to FIG. 1 to FIG. 3.

Figure 2:
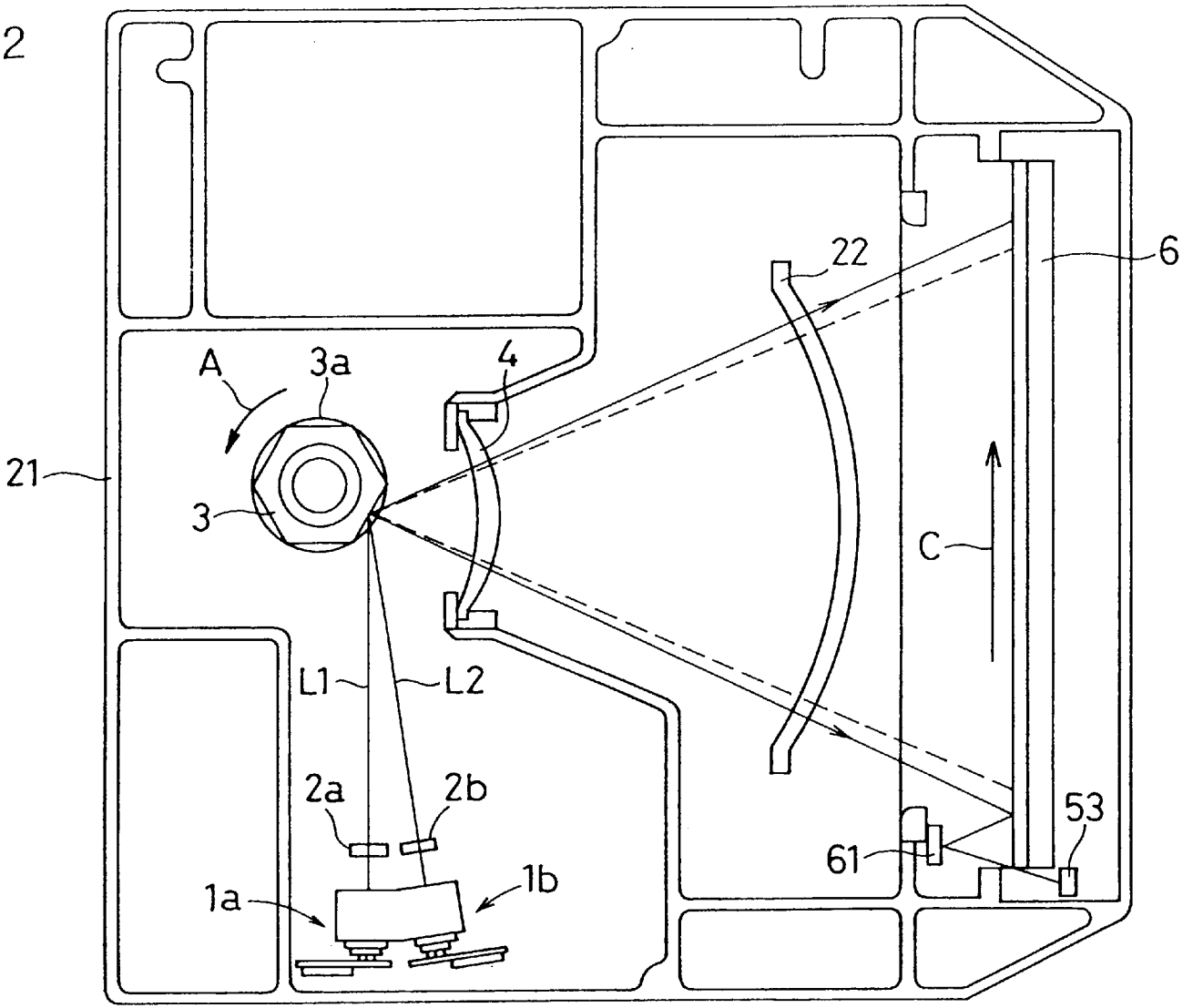
FIG. 2 is a top view showing an optical system in FIG. 1.
Figure 3:
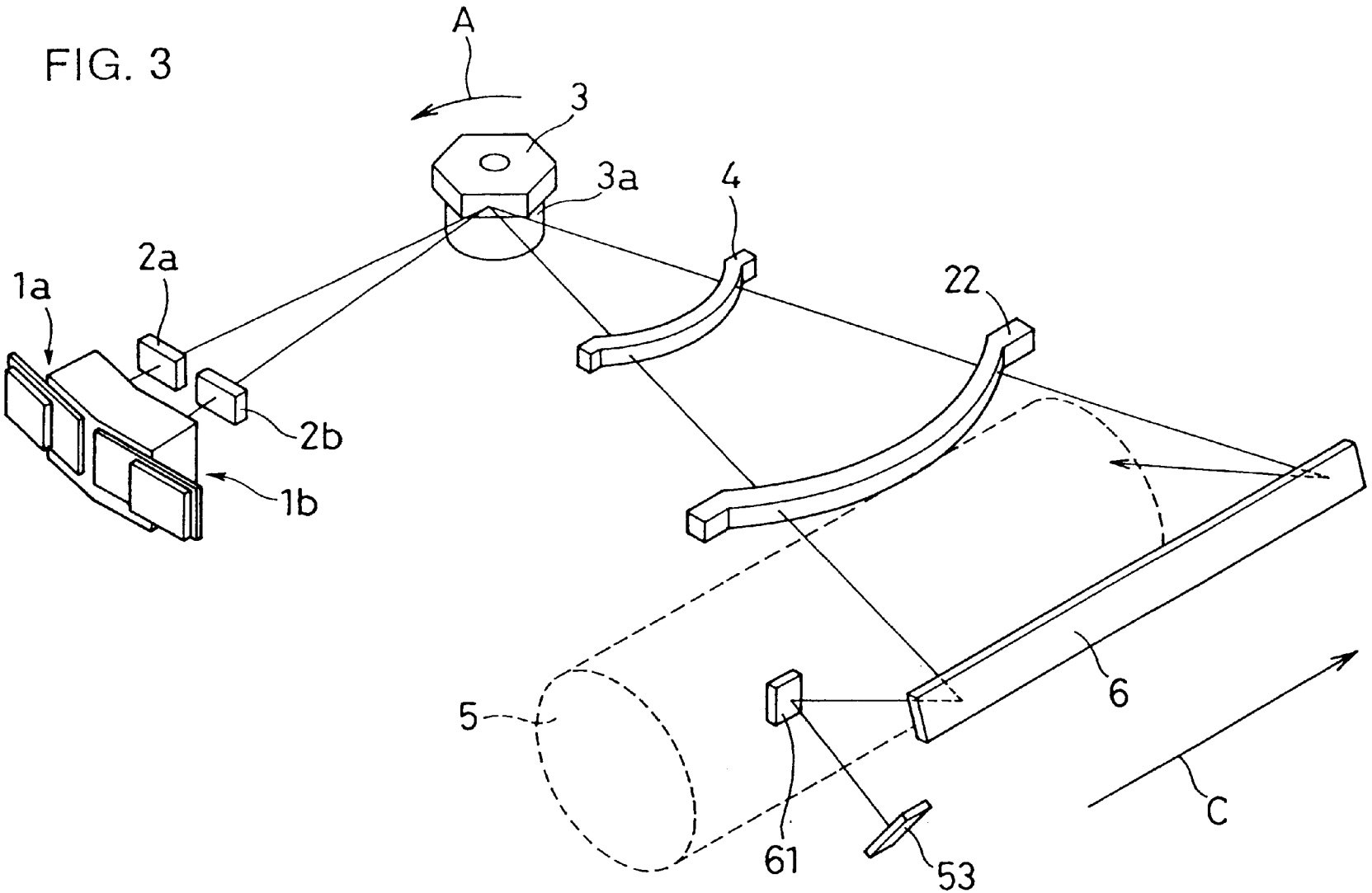
FIG. 3 is a perspective view showing a construction of the optical system in FIG. 1.

Referring now to the drawings, FIG. 1 is a view showing a general construction of a laser printer (as seen from the side thereof), FIG. 2 is a top view showing an optical system in FIG. 1, and FIG. 3 is a perspective view showing a construction of the optical system in FIG. 1.

Figure 4:
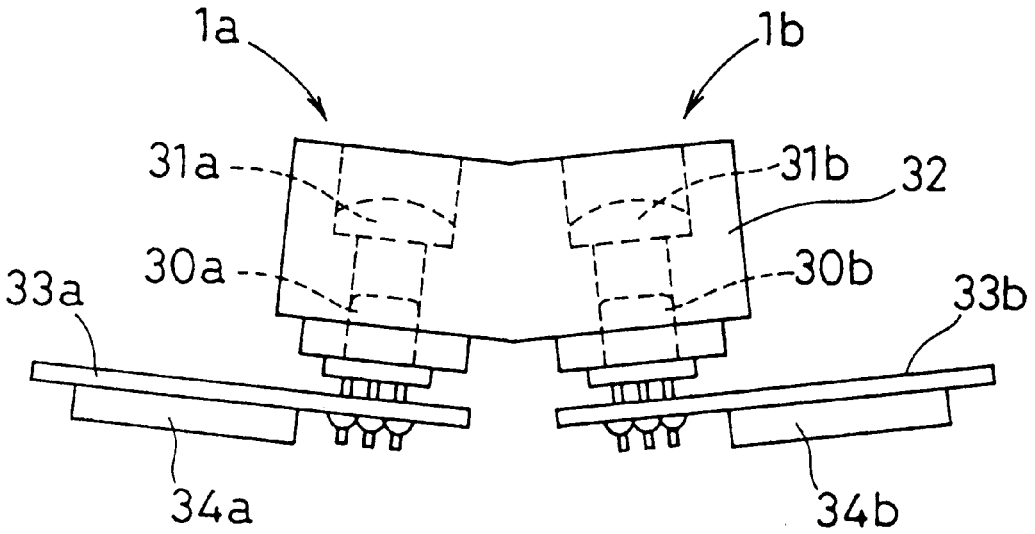
FIG. 4 is a top view of a light source device according to the embodiment of the present invention.

As shown in these figures, the laser printer according to the present invention is equipped with a pair of light source devices 1*a,* 1*b* (FIG. 2) for emitting beams L1,L2 corresponding to input video signals, respectively, and cylindrical lenses 2*a,*2*b* for adjusting cross-sectional forms of the two beams L1,L2 emitted by the light source devices 1*a,*1*b*. The light source devices 1*a,*1*b* and the cylindrical lenses 2*a,*2*b* are disposed in an optical system housing 21. As shown in FIG. 4, the light source devices, 1*a,*1*b* include laser diodes 30*a,*30*b*for emitting the beams L1,L2 and collimator lenses 31*a,*31*b* for collimating the beams L1,L2, respectively.

The laser printer is further equipped with a polygonal mirror 3 for reflecting the beams L1,L2 passing through the cylindrical lenses 2*a,*2*b* with its six mirror surfaces, a motor 3*a*for rotating the polygonal mirror 3 at a constant speed in the direction of arrow A, an f·θ lens 4 for correcting the distortion aberration of beams reflected by the polygonal mirror 3, cylindrical lens 22 (with f·θ function) for correcting surface troubles of the beams L1,L2, and a plane mirror 6 for reflecting the beams passing through the f·θ lens 4 and the cylindrical lens 22 to form images at designated positions P1,P2 on a photoconductor drum 5 (FIG. 1).

The polygonal mirror 3 is arranged such that it rotates in the direction of arrow A to scan the photoconductor drum 5 in the direction of arrow C in such a manner that the beams L1,L2 are received through a mirror 61 by a beam sensor 53 made of a photodiode and the sensor 53 detects the beginning of each scanning.

As shown in FIG. 1, the printer further includes a charging corona-discharge device 7 for uniformly charging the surface of the photoconductor drum 5 which rotates in the direction of arrow B, a development unit 9 for supplying a developing agent to the surface of the photoconductor drum 5 by a development roller 8, a cassette 11 for housing recording sheets 10 therein, a feeding roller 12 for feeding the recording sheet 10 in the cassette 11, a pair of conveying rollers 13,13 for conveying the recording sheet 10, a resist roller 14 for intermittently transmitting the recording sheet 10 toward the photoconductor drum 5 in synchronization with the prescribed timing, a transferring corona-discharge device 9 for charging the recording sheet 10 conveyed from the resist roller 14 by corona discharge and transferring the developed image from the photoconductor drum 5 onto the surface of the recording sheet 10, a pair of separation rollers 15 for separating the image-transferred recording sheet from the photoconductor drum 5, a pair of fixing rollers 17 for fixing the image on the separated recording sheet by heating, a discharging roller 18 for discharging the recording sheet 10 which has finished the fixing process, a tray 19 for receiving the discharged recording sheet 10, and a cleaning unit 20 for cleaning the surface of photoconductor drum 5 which has finished the transferring process.

Next, overall operation of the printer constructed as described above is now described.

As shown in FIG. 2 and FIG. 3, when the beams L1,L2 are emitted by the light source devices 1*a,*1*b,* the beams L1,L2 are reflected by the polygonal mirror 3 rotating in the direction of arrow A and received, at first, by the beam sensor 53 through the f·θ lens 4, the cylindrical lens 22, and the plane mirror 6. Next, the beams are focused to form images at the positions P1,P2 on the surface of the photoconductor drum 5 and are allowed to scan the photoconductor drum 5 in the direction of arrow C by means of rotation of the polygonal mirror 3. In each scanning period, when a detection signal from the beam sensor 53 receiving the beams L1,L2 is inputted into a control section (not shown), the control section modulates the beams L1,L2 in synchronization therewith for a prescribed printing period of time according to the video signal.

On the other hand, the surface of the photoconductor drum 5 previously charged uniformly by the charging corona-discharge device 7 and rotating in the direction of arrow B is scanned by the beams L1,L2 during the printing period, whereby an electrostatic latent image is formed thereon. The electrostatic latent image is visualized (revealed) as the developing agent is applied by the development roller 8.

The recording sheet 10 housed in the cassette 11 is drawn out by the feeding roller 12. When the recording sheet 10 is conveyed by the conveying roller 13 and the top thereof reaches the resist roller 14, it stops for a while. When the resist roller 14 is actuated in synchronization with the progress of forming a visualized image on the photoconductor drum 5, the recording sheet 10 is conveyed to the lower side of the photoconductor drum 5 by the resist roller 14 so that it comes in contact with the visualized image on the photoconductor drum 5.

Then, the transferring corona-discharge device 9 is discharged, and the developing agent which forms the visualized image on the surface of the photoconductor drum 5 is moved (transferred) to the recording sheet. The image-transferred recording sheet is detached from the photoconductor drum 5 by the separation roller 15 to be conveyed to the fixing roller 17.

Next, when the recording sheet which has finished the fixation of image through heating by the fixing roller 17 is discharged to the tray 19 by the discharging roller 18, a printing cycle for one recording sheet is finished. The surface of the photoconductor drum 5, which has just finished transferring the image, is cleaned by the cleaning unit 20 and kept ready for the next printing cycle.

2. Detailed Construction and Operation of the Principal Elements

Next, the construction and operation of the light source device characterizing this invention is now described in detail.

Figure 5:
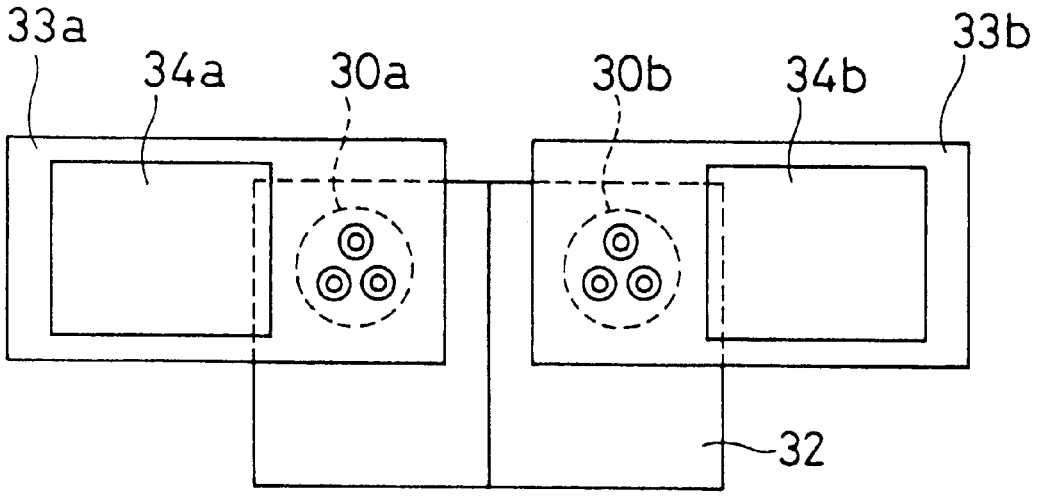
FIG. 5 is a rear view of the light source device according to the embodiment of the present invention.

FIGS. 4 and 5 are a top view and a rear view showing the light source devices 1*a,*1*b,* respectively. As shown in these figures, the laser diodes 30*a,*30*b,* which serve as light-emitting elements, and collimator lenses 31*a,*31*b* are mounted in a common plastic holder 32 and fixed by an adhesive.

Lead wires of the laser diodes 30*a*,30*b* are mounted on two printed circuit boards 33*a*,33*b*, respectively, and laser diode driving IC modules 34*a*,34*b* for driving the laser diodes 30*a*,30*b* are also mounted on the printed circuit boards 33*a*,33*b*, respectively.

Figure 6:
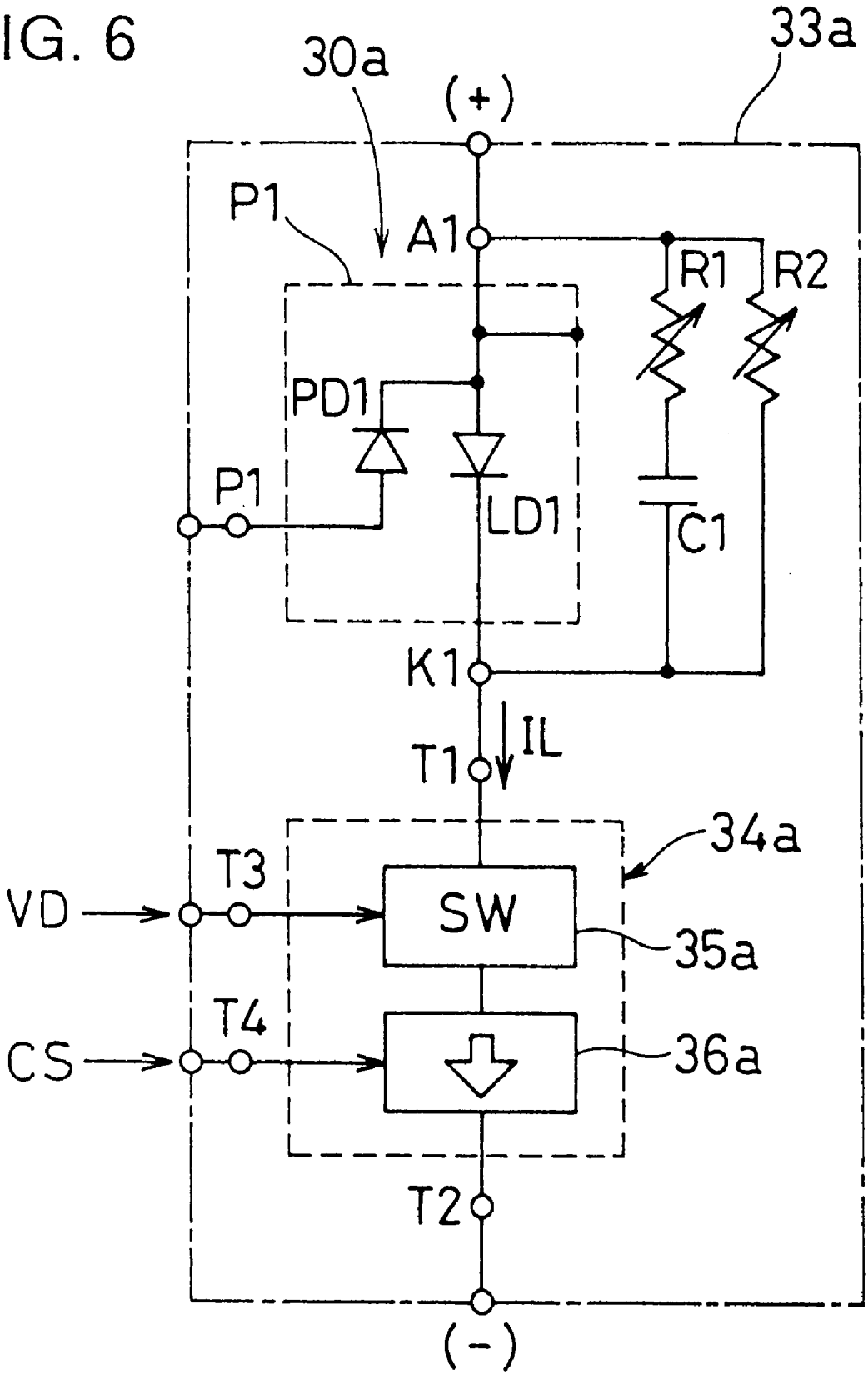
FIG. 6 is a view showing an electrical circuit diagram of the light source device according to the embodiment of the present invention.

FIG. 6 is an electric circuit diagram showing the laser diode driving IC module 34*a*mounted on the printed circuit board 33*a*. As shown in FIG. 6, the laser diode 30*a* includes a laser diode element LD1, a photodiode element PD1 for monitoring an intensity of the light emitted from the laser diode element LD1, and a metallic package (a can package) P1 for housing them therein. The anode Al of the laser diode element LD1 and the cathode of the photodiode element PD1 are electrically connected to the package P1 The laser diode 30*b* has the same construction as the laser diode 30*a* and also includes a laser diode element LD1.

Here, the laser diode elements LD1 of the laser diodes 30*a*, 30*b* may be included as a pair in a common package. Generally, each laser diode element is individually constituted. Alternatively, however, a plurality of laser elements can be formed by device isolation on a common semiconductor substrate to obtain parallel beams.

The laser diode driving IC module 34*a* is connected through a terminal T1 to the cathode K1 of the laser diode element LD1. The laser diode driving IC module 34*a* includes a switching element 35*a* and a current adjustable circuit 36*a*. The switching element 35*a* switches the electric current IL for driving the laser diode element LD1 according to a video signal VD supplied through an input terminal T3 from outside. The current adjustable circuit 36*a* adjusts a magnitude of the driving electric current IL according to a control signal CS supplied through an input terminal T4 from outside. The magnitude of the current IL determines the maximum dot density.

A snubber circuit, which is a series circuit including a variable resistor R1 and a capacitor C1, and a variable resistor R2 for discharging the capacitor C1 are connected between the anode and the cathode of the laser diode LD1.

The laser diode driving element on the printed circuit board 33*b* is equivalent to the circuit shown in FIG. 6. In this embodiment, RLD 78 NP-D type made by Rohm Co., Ltd. is used as the laser diodes 30*a*, 30*b* and SN 65ALS542 type made by Texas Instruments Co., Ltd. is used as the laser diode driving IC, respectively.

Figure 8:
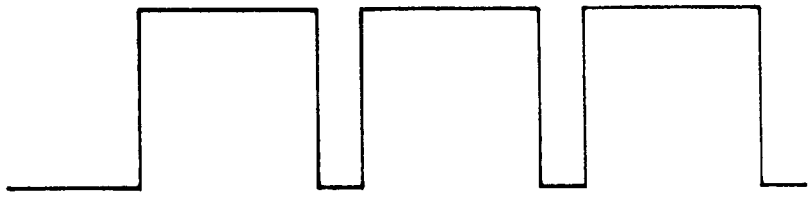
FIG. 8(*a*) is a view showing a waveform of a video signal supplied to a terminal of a switching element according to the present invention.
Figure 8:
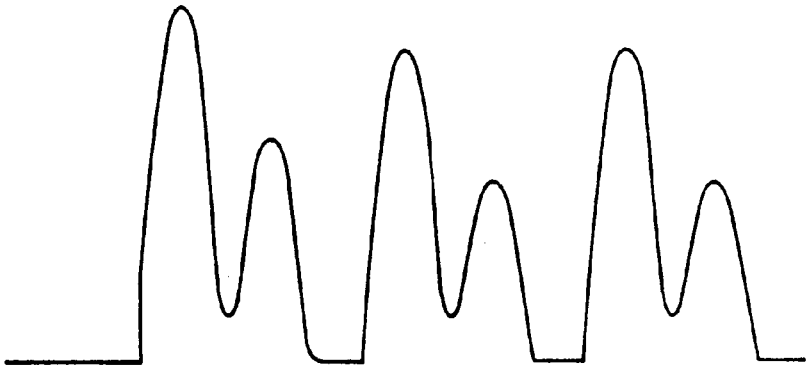
Figure 8:
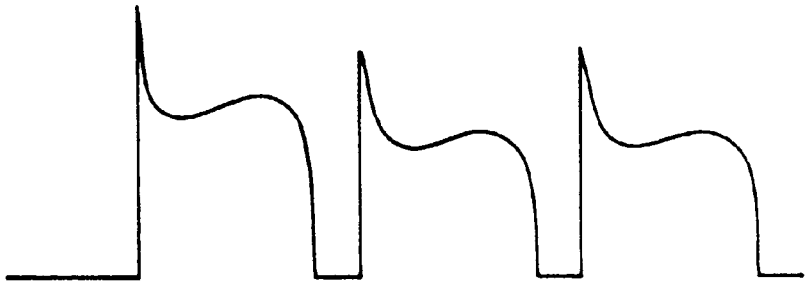
Figure 8:
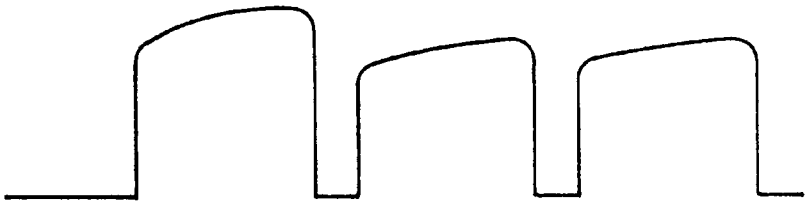
Figure 8:
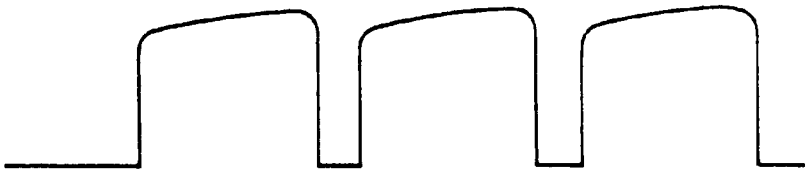

In such a construction, the anode A1 is connected to a positive electrode of a d.c. power supply 100 and the terminal T2 of the IC 34*a* is connected to a negative electrode of the power supply 100, wherein a direct current voltage is applied therebetween. When the video signal VD having a pulse waveform shown in FIG. 8(*a*) (one pulse corresponding to one dot in the image) is thus applied to the terminal T3, the intensity of light emitted by the laser diode 30*a* changes in an approximately rectangular pulse shape in correspondence with the video signal VD, as shown in FIG. 8(*e*). The intensity of light emitted by the laser diode 30*b* also changes in an approximately rectangular shape, as shown in FIG. 8(*e*).

Next, the characteristics, function and effect of the circuit structure of this embodiment shown in FIG. 6 are now described with reference to a comparative example shown in FIG. 7.

Figure 7:
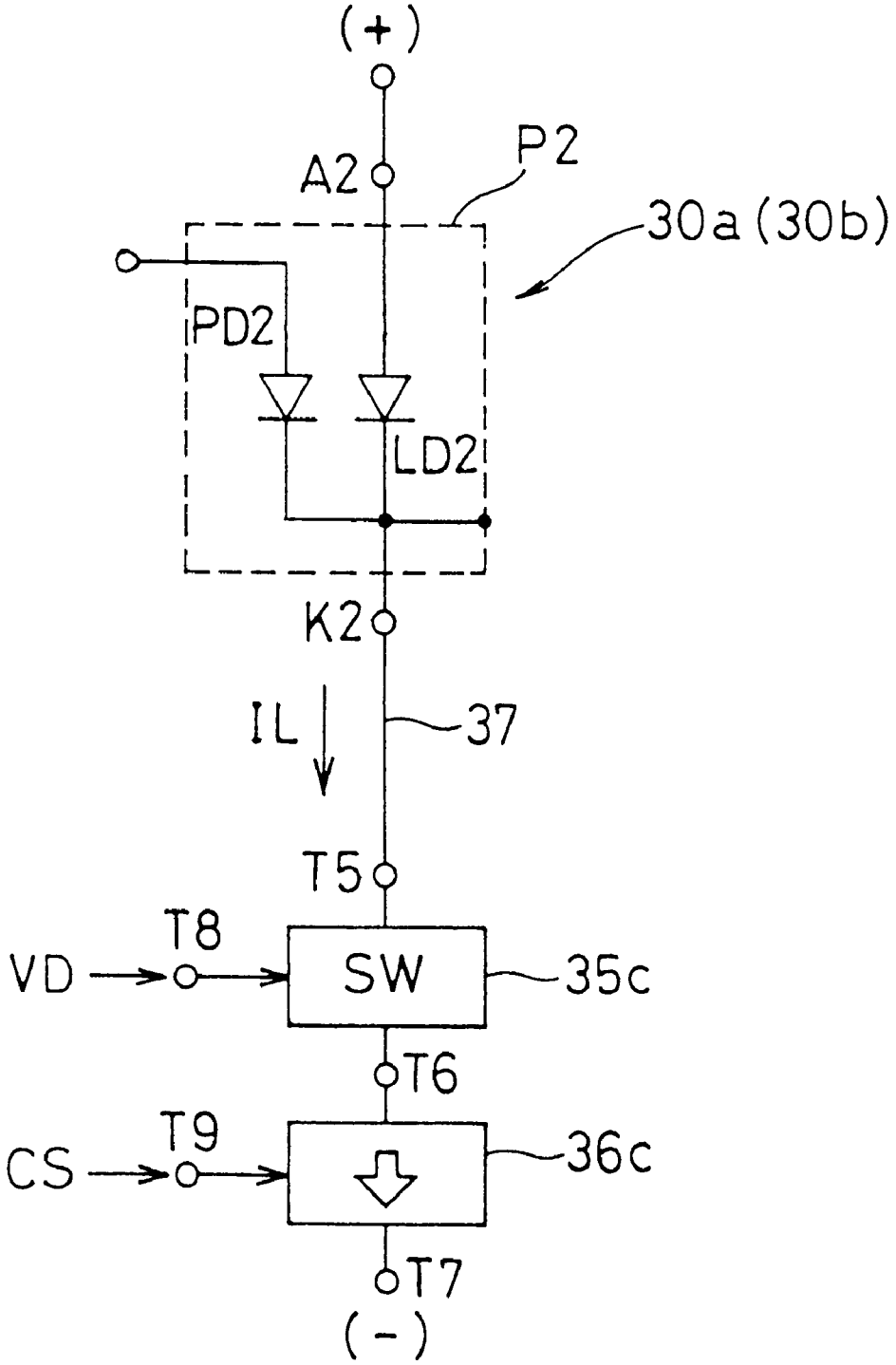
FIG. 7 (PRIOR ART)
FIG. 7 is a view corresponding to FIG. 6 according to a comparative example.

In FIG. 7, the laser diodes 30*a*,30*b* consist of a laser diode element LD2, a photodiode PD2 for monitoring, and a metallic package P2 for housing these therein. The cathode K2 of the laser diode element LD2 and the photodiode PD2 are electrically connected to the package P2.

The terminal T5 of the switching element 35C is connected through a lead cable 37 of about 200 mm to the cathode K2, the switching element 35C being connected through a terminal T6 to a current adjustable circuit 36C. Thus, a magnitude of the laser diode driving current IL is to be adjusted by supplying a video signal to the input terminal T8 of the switching element to switch the laser diode driving current IL and by supplying a control signal CS to the input terminal T9 of the current adjustable circuit 36C when a direct current voltage is applied between the anode A2 and the terminal T7 of the current adjustable circuit 36C.

In such a construction of the comparative example, when a direct current voltage is applied between the anode A2 and the terminal T7 of the current adjustable circuit 36C in the same manner as in FIG. 6 and the video signal VD having a pulse waveform shown in FIG. 8(*a*) is supplied to the input terminal T8 of the switching element 35C, the intensity of light emitted by the laser diode 30*a* vibrates greatly with large fluctuations as shown in FIG. 8(*b*), so that it is impossible to control the magnitude of the intensity by means of the control signal CS supplied to the input terminal T9 of the current adjustable circuit 36C.

This is caused by the fact that the electric current IL for driving the laser diode 30*a* is affected by the stray capacitance of the circuit. Therefore, the lead cable 37 is removed and the switching element 35C is integrated with the current adjustable circuit 36C. That is, instead of the switching element 35C and the current adjustable circuit 36C, the same laser diode driving IC module as that used in the embodiment is mounted on a single printed circuit board together with the laser diode 30*a*. Thus, the waveform of the intensity of light emitted by the laser diode 30*a* is reformed in shape as shown in FIG. 8(*c*).

However, the waveform of FIG. 8(*c*) has a large rising edge, showing an overshoot. Accordingly, a series circuit of a variable resistor R1 and capacitor C1, and a variable resistor R2 are connected in parallel between the anode A2 and the cathode K2 in a manner similar to the embodiment of the present invention. Thus, the waveform of the intensity of emitted light becomes as shown in FIG. 8(*d*) and the overshoot is eliminated by adjustment of the variable resistors R1,R2.

It is however obvious that a moiré occurs when an image is formed by such a laser light, because the height of the intensity waveform of emitted light corresponding to the first dot is high compared with the height of the other waveforms succeeding thereto.

Thus, the intensity waveform of the emitted light corresponding to the first dot only is high. This seems to be due to the following reason. Since the cathode K2 for the laser diode 30*a* and the photodiode PD2 are electrically connected to the metallic package P2 as shown in FIG. 7, a relatively large stray capacitance exists among the package P2, the photodiode PD2, and the ground, so that the electric current for charging the stray capacitance is added to the electric current flowing into the laser diode element LD2 for the first dot, thereby increasing the laser diode driving current.

The laser diode 30*a* is accordingly replaced with the same one as in the embodiment. That is, it is so constructed that the anode of the laser diode element and the cathode of the photodiode element are connected to the package, and the positive electrode of the power supply is always connected to the package to charge the stray capacitance beforehand. At this time, the intensity waveform of emitted light is approximately rectangular and uniform for every dot, as shown in FIG. 8(*e*), allowing the height of the waveform to be controlled by the control signal CS. As a result, it has been accordingly ascertained that the comparative example should have the same circuit structure as the embodiment of this invention.

According to the light source device of this invention, the density of each dot forming the image becomes uniform and phenomena like moiré does not occur, because a stable intensity waveform of emitted light can be obtained in correspondence with the video signal, thus providing high-quality images.

According to this invention, the intensity waveform of light emitted by the laser diode is approximately rectangular and uniform for every dot in the image, so that dot by dot fluctuations in the image density can be prevented, thereby providing a high-quality image without moiré.

Although the present invention has fully been described by way of example with reference to the accompanying drawings, it is to be understood that various changes and modifications will be apparent to those skilled in the art. Therefore, unless otherwise such changes and modifications depart from the spirit and scope of the invention, they should be construed as being included therein.

What is claimed is:

1. An image forming apparatus comprising:

a plurality of light-emitting elements, each light-emitting element receiving a driving current form a power supply and converting the current into a beam;

a plurality of driving elements, each driving element being electrically connected between the power supply and each light-emitting element and controlling the driving current for each light-emitting element based on an image signal; and a photoconductor on which the beams from the plurality of light-emitting elements form an image by scanning, wherein each light-emitting element is positioned adjacent to each driving element on a single printed circuit board such that a power leakage factor floating between the light-emitting element and the driving element is reduced, whereby an intensity of the beam is substantially equivalent to the image signal in waveform, and wherein each light-emitting element includes a laser diode mounted in a metallic package, an anode of the laser diode being connected to the metallic package.

2. The image forming apparatus of claim 1, wherein each light-emitting element comprises a laser diode and the power supply comprises a d.c. power supply, an anode of the laser diode being connected to a positive electrode of the power supply, a cathode of the laser diode being connected to a negative electrode of the power supply through the driving element.

3. The image forming apparatus as recited in claim 2, wherein the cathode is connected to the driving element through a wiring printed on said single printed circuit board.

4. The image forming apparatus of claim 2 wherein each laser diode further includes a photodiode in the metallic package, the photodiode monitoring a light intensity of laser beam emitted by the laser diode, and a cathode of the photodiode being connected to the metallic package.

5. The image forming apparatus of claim 2 wherein each laser diode and each driving element corresponding thereto are mounted on a single printed circuit board.

6. The image forming apparatus of claim 2 wherein the laser diode driving element comprises an integrated circuit module including a switching circuit for on-off switching of the driving current supplied to the laser diode and a current adjustable circuit for adjusting a magnitude of driving current, the integrated circuit module being arranged adjacent to the corresponding laser diode.

7. The image forming apparatus of claims 2 wherein a snubber circuit is electrically connected parallel to the laser diode.

8. An image forming apparatus comprising:

a plurality of light-emitting elements, each light-emitting element receiving a driving current from a power supply and converting the current into a beam;

a plurality of driving elements, each driving element being electrically connected between the power supply and each light-emitting element and controlling the driving current for each light-emitting element based on an image signal; and a photoconductor on which the beams from the plurality of light-emitting elements form an image by scanning, wherein each light-emitting element is positioned adjacent to each driving element such that a power leakage factor floating between the light-emitting element and the driving element is reduced, whereby an intensity of the beam is substantially equivalent to the image signal in waveform, wherein each light-emitting element comprises a laser diode and the power supply comprises a d.c. power supply, an anode of the laser diode being connected to a positive electrode of the power supply, a cathode of the laser diode being connected to a negative electrode of the power supply through the driving element, and wherein each laser diode is mounted in a metallic package, the anode of the laser diode being connected to the metallic package.

9. An image forming apparatus comprising:

a plurality of laser diodes, each laser diodes receiving a driving current from a d.c. power supply and converting the current into a beam;

a plurality of driving elements, each driving element being interposed between the power supply and each laser diode and controlling the driving current based on an image signal; and a photoconductor on which the beams from the plurality of laser diodes form an image by scanning, wherein each laser diode is mounted in a metallic package, an anode of the laser diode being connected to the metallic package and to a positive electrode of the power supply, a cathode of the laser diode being connected to a negative electrode of the power supply through the driving element.

* * * * *